United States Patent [19]

Sasaki et al.

[11] Patent Number: 4,943,395

[45] Date of Patent: Jul. 24, 1990

[54] PROCESS OF VITRIFYING RADIOACTIVE LIQUID WASTE WITH SUPPRESSED FORMATION OF GASEOUS RUTHENIUM

[75] Inventors: Noriaki Sasaki, Katsuta; Kazuhisa Matsunaka, Naka, both of Japan

[73] Assignee: Doryokuro Kakunenryo Kaihatsu Jigyodan, Tokyo, Japan

[21] Appl. No.: 327,773

[22] Filed: Mar. 23, 1989

[30] Foreign Application Priority Data

Mar. 28, 1988 [JP] Japan ..... 63-73710

[51] Int. Cl.[5] ..... G21F 9/16; G21F 9/08

[52] U.S. Cl. ..... 252/629; 252/631; 264/56

[58] Field of Search ..... 252/629, 631; 65/32.1, 65/32.2; 250/506.1; 264/56; 501/35; 423/22

[56] References Cited

U.S. PATENT DOCUMENTS

| | | | |
|---|---|---|---|
| 3,849,330 | 11/1974 | Isaacson et al. | 423/249 |
| 4,111,831 | 9/1978 | Maness | 422/12 |
| 4,202,792 | 5/1980 | Kaufmann et al. | 252/629 |
| 4,224,177 | 9/1980 | Macedo et al. | 252/629 |
| 4,271,034 | 6/1981 | Gattys | 252/629 |
| 4,312,774 | 1/1982 | Macedo et al. | 252/629 |
| 4,333,847 | 6/1982 | Tran et al. | 252/629 |
| 4,344,872 | 8/1982 | Thiele | 252/629 |
| 4,362,659 | 12/1982 | Macedo et al. | 252/629 |
| 4,469,628 | 9/1984 | Simmons et al. | 252/629 |
| 4,528,011 | 7/1985 | Macedo et al. | 65/30.13 |
| 4,544,499 | 10/1985 | Tran et al. | 252/629 |
| 4,737,316 | 4/1988 | Macedo et al. | 252/633 |
| 4,822,525 | 4/1989 | Endo et al. | 252/629 |

FOREIGN PATENT DOCUMENTS

| | | |
|---|---|---|
| 60-80796 | 5/1985 | Japan . |
| 60-186797 | 9/1985 | Japan . |

OTHER PUBLICATIONS

Control of Semivolatile Radionuclides in Gaseous Effluents at Nuclear Facilities; Technical Reports Series No. 220.

Solidification of the High-Level Liquid Waste from the Tokai Reprocessing Plant; by N. Sasaki et al.; Power Reactor and Nuclear Fuel Development Corp. [(1-147) to (1-159)].

*Primary Examiner*—Howard J. Locker

*Attorney, Agent, or Firm*—Wenderoth, Lind & Ponack

[57] ABSTRACT

An improved process of vitrifying a radioactive liquid waste by absorbing a radioactive liquid waste into a glass frit cartridge made of molded glass fibers and heat-melting the cartridge to vitrify the liquid waste. The invention is characterized by absorbing a radioactive liquid waste containing ruthenium into the glass frit cartridge together with a reducing agent. By the process of the invention, the formation of gaseous ruthenium is effectively suppressed during the heat-melting.

11 Claims, 1 Drawing Sheet

PROCESS OF VITRIFYING RADIOACTIVE LIQUID WASTE WITH SUPPRESSED FORMATION OF GASEOUS RUTHENIUM

BACKGROUND OF THE INVENTION

The present invention relates to a process of vitrifying a radioactive liquid waste containing ruthenium, and more particularly to a process of vitrifying a radioactive liquid waste which can prevent the formation of gaseous ruthenium when a high-level radioactive liquid waste containing radioactive ruthenium is solidified by heat-melting the same together with a glass frit cartridge.

Conventional prior art techniques for vitrification of a high level radioactive liquid waste include a liquid-fed direct energization (e.g. Joule heated) ceramic melter system. In this system, a high-level radioactive liquid waste is fed in liquid form, after adjusting its composition if necessary, into a glass-melting furnace called a Joule heated (directly heated) ceramic melter, in which the liquid waste is subjected to evaporation drying. calcination and finally vitrification. This technique has been developed mainly in Japan West Germany, and United States of America.

Among the variations of the above described system. also known is a process which comprises absorbing a high-level radioactive liquid waste into a glass frit cartridge made of molded glass fibers, feeding the cartridge into a glass-melting furnace, in which the radioactive liquid waste is finally vitrified (see, for example, Japanese patent Laid-open Specification Nos.60-80796 and 60-186797). This process has an advantage over the case where the liquid waste is fed into the furnace without being absorbed into a glass frit cartridge in that it hardly brings about the occurrence of mist and dust and therefore can eliminate problems such as clogging of a off-gas treating apparatus.

A high-level radioactive liquid waste generated from a reprocessing of spent fuels in a light water reactor by using Purex process is a solution acidified with nitric acid and contains radioactive ruthenium which is a fission product. When vitrifying such a liquid waste in the above-described liquid-fed Joule heated ceramic melte system, radioactive ruthenium contained in the liquid waste is oxidized by a gas produced by decomposition of nitric acid or nitrate during evaporation, calcination, and vitrification of the liquid waste in the melting furnace, which brings about a phenomenon that the oxidized ruthenium is mixed in gaseous form into the off-gas. It is reported that the gaseous radioactive ruthenium contained in the off-gas in this case amounts to about 20% of the amount of the ruthenium fed into the melting furnace depending upon the conditions (see "Control of Semivolatile Radionuclides in Gaseous Effluents ai Nuclear Facilities", Technical Reports Series No.220, International Atomic Energy Agency, Vienna, 1982).

However, it is necessary from the viewpoint of environmental safety to minimize the amount of the gaseous radioactive ruthenium contained in the off-gas released into the air. For this reason, various types of wet scrubbers and adsorption columns have been developed and used for the purpose of removing the gaseous radioactive ruthenium from the off gas (see the above-described publication). Although it is technically possible to attain necessary removal capacity through combination of the above described apparatuses, it has drawbacks that the off-gas treatment system is complicated and that since a large amount of radioactive ruthenium is contained in a secondary liquid waste generated from the wet scrubbers and the like, gaseous radioactive ruthenium is again formed during the step of the treatment of such secondary liquid waste.

In order to eliminate the above-described drawbacks, an attempt has been made to decompose and remove nitric acid or nitrate (hereinafter referred to as "denitration") contained in a liquid waste with formic acid, formalin, sugar, or the like before a high level radioactive liquid waste is fed into a melting furnace, thereby suppressing the formation of gaseous radioactive ruthenium through suppression of the oxidation of ruthenium by the gas produced by decomposition of nitric acid or nitrate in the melting furnace (see, for example, N. Sasaki et al., "Solidification of the High Level Liquid Waste from the Tokai Reprocessing Plant", Proceeding of the American Nuclear Society, International Meeting on Fuel Reprocessing and Waste Management, Jackson, Wyoming, Aug. 16–29, 1984).

However, in the above-described process wherein a high-level radioactive liquid waste is treated by adding a reducing agent to the liquid waste before the liquid waste is fed into a melting furnace, nitric acid contained in the liquid waste is decomposed and removed, so that there occurs precipitation of a large amount of fission products dissolved in the liquid waste. This brings about problems that it is difficult to conduct agitation and liquid transfer and &ha& the precipitate is deposited on the inner wall of a container.

SUMMARY OF THE INVENTION

An object of the present invention is to provide an improved process of vitrifying a high level radioactive liquid waste by using a liquid-fed Joule heated ceramic melter, which process can suppress the formation of gaseous ruthenium and also maintain the advantageous effects obtained by absorbing the liquid waste into a glass frit cartridge made of molded glass fibers.

Further object of the present invention is to provide an improved process of vitrifying a high-level radioactive liquid waste with suppressed formation of gaseous ruthenium, which process does not require any additional reactor and control means thereof, thereby simplifying an off-gas treatment system and a secondary liquid waste treatment system.

According to the present invention, there is provided a process of vitrifying a radioactive liquid waste by absorbing a radioactive liquid waste into a glass frit cartridge made of molded glass fibers and heat melting said cartridge to vitrify said liquid waste, characterized in that a radioactive liquid waste containing ruthenium is absorbed together with a reducing agent into said glass frit cartridge, thereby suppressing the formation of gaseous ruthenium during the heat-melting.

The step of absorbing the liquid waste may be conducted by absorbing the liquid waste into the glass frit cartridge containIng a solid reducing agent previously incorporated therein. Alternatively, a liquid reducing agent may be absorbed together with a radioactive liquid waste into the glass frit cartridge.

The present invention makes it possible not only to maintain the advantage of the conventional process wherein a glass frit cartridge containing a high level radioactive liquid waste absorbed thereinto is vitrified in a glass-melting furnace but also to efficiently denitrate the liquid waste with a reducing agent, since the contact of the reducing agent with the liquid waste can be uniformly and effectively conducted through the glass frit cartridge. Therefore, there occurs no oxidation of ruthenium contained in the liquid waste with a gas produced by decomposition of nitric acid or nitrate thus making it possible to suppress the formation of gaseous ruthenium resulting from the oxidation of ruthenium.

Although it is possible to feed the reducing agent directly into a melting furnace, the places where the denitration occurs within the furnace become nonuniform unfavorably. Further, the use of glass frit in the form of beads or powder, instead of glass fibers, brings about problems that not only places at which the denitration occur are nonuniform but also the amount of dust transferred into the off gas is remarkably increased.

PREFERRED EMBODIMENTS OF THE INVENTION

The present invention will now be described in more detail with reference to the accompanying drawings.

Figure 1:
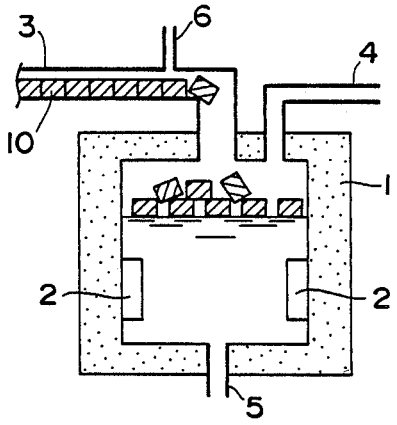
FIG.1 is an explanatory view of an example of apparatus which can be used in practicing the present invention.

FIG.1 illustrates an example of the present invention which comprises absorbing a high-level radioactive liquid waste into a glass frit cartridge made of molded glass fibers and containing a solid powdery reducing agent, such as sugar or corn starch previously incorporated therein and then melting the cartridge in a liquid-fed Joule heated ceramic melter. The ceramic melter 1 has a pair of electrodes 2 provided at the lower part of the inside thereof and is provided with a glass frit cartridge feed pipe 3 and an off-gas pipe 4 at the top thereof and with a molten glass drain nozzle 5 a& the bottom thereof. A high level radioactive liquid waste feed pipe 6 communicates with the cartridge feed pipe 3 in the midway thereof.

The glass frit cartridge used in the present invention is preferably a cylindrically shaped glass fiber aggregate having excellent water absorptivity and prepared by, for example, rolling a sheet of glass fibers or sintering glass fibers in a mold. Such a glass frit cartridge has a composition determined based on the composition of the liquid waste to be treated and the desired composition of a final vitrified product.

A glass frit cartridge 10 containing a reducing agent, such as sugar, previously incorporated therein is successively transferred from a cartridge feeder (not shown) through the cartridge feed pipe 3. When the cartridge comes beneath the liquid waste feed pipe 6, a predetermined amount of the high level radioactive liquid waste is poured onto the cartridge to absorb the liquid waste into the cartridge 10. The cartridge containing the liquid waste absorbed thereinto further advances and drops into the ceramic melter 1, where heat-melting of the glass frit and denitration with the reducing agent are carried out.

The amount of the reducing agent can be determined based on a stoichiometric amount from the concentration of nitric acid or nitrate contained in the liquid waste.

Figure 2:
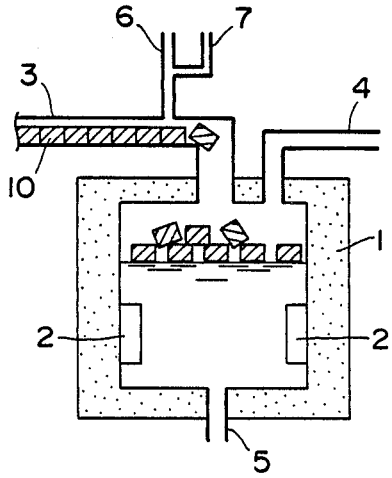
FIG.2 is an explanatory view of another example of apparatus which can be used in practicing the present invention.

FIG.2 illustrates another example of the present invention which comprises absorbing a liquid reducing agent into a glass frit cartridge together with a high-level radioactive liquid waste and melting the cartridge in the ceramic melter. Since the apparatus shown in FIG.2 has the same fundamental structure as that of the one shown in FIG. 1. the same reference numeral as that of FIG.1 is given to the same member as that of FIG.1 for omission of the explanation. The apparatus shown in FIG.2 is different from the one shown in FIG.1 in that a liquid reducing agent feed pipe 7 communicates with the liquid waste feed pipe 6 in the midway thereof. Thus, the liquid reducing agent from the pipe 7 is mixed into the liquid waste which flows down through the liquid waste feed pipe 6, and the mixed liquid is absorbed into the glass frit cartridge 10.

Examples of the liquid reducing agent include aqueous solutions of solid reducing agents, such as sugar and corn starch, and liquid reducing agents, such as formic acid and formalin. The amount of addition of the liquid reducing agent can be determined by the same method as that used in the case of the solid reducing agent.

The liquid reducing agent feed pipe 7 shown in FIG.2 may directly communicate with the glass frit cartridge feed pipe 3 instead of communicating with the liquid waste feed pipe 6 in the midway thereof. In this case, the liquid reducing agent feed pipe ? may communicate with the glass frit cartridge feed pipe 3 on the upstream or downstream side of the liquid waste pipe 6.

EXAMPLE

A liquid-fed Joule heated ceramic melter (surface area of melt: 0.82 $m^2$) as shown in FIG.2 has heated through Joule heating by applying a power of about 57 kW. A ruthenium-containing solution which simulated a high-level radioactive liquid waste (hereinafter referred to as "simulated liquid waste") was fed from the liquid waste feed pipe 6 into &he melter at a rate of about 14 to 15 1/hr while a car&ridge made of molded glass fibers was fed from the cartridge feed pipe 3 into the melter at a rate of 5.3 to 5.5 kg/hr, where the glass frit cartridge was heated and melted.

A comparison was made with respect to the percentage of gaseous ruthenium released from the melter between the case where an aqueous sugar solution (concentration: 2.5 mol/l) was fed from the reducing agent feed pipe 7 at a rate of about 3.9 1/hr and the case where no sugar solution was fed.

The amount of gaseous ruthenium contained in off-gas from the melter was determined by sampling the gas from the off-gas pipe 4 and absorbing gaseous ruthenium contained in the sample into a absorbing solution to analyze the gaseous ruthenium.

The feed rate of the sugar was determined on an assumption that the content of the removable nitrate in the simulated liquid waste gas about 3.9 mol/l and the denitration was carried out according to the following reaction formula:

$$12HNO_3 + C_{12}H_{22}O_{11} \rightarrow 12CO + 6N_2O_3 + 17H_2O$$

The percentage volatilization of gaseous ruthenium from the melter (percentage of ruthenium which volatilizes in the gaseous form into the off-gas with respect to ruthenium fed into the melter) was as follows:

| | |
|---|---|
| reducing agent present | about 0.1 to 0.2% |

-continued

| | |
|---|---|
| no reducing agent present | about 10 to 11%. |

As is apparent from the above-described results when the cartridge containing the mixed solution of reducing agent and liquid waste was heated and melted the percentage volatilization of gaseous ruthenium from the melter decreased to 1/50 to 1/100, thus the formation of gaseous ruthenium was suppressed.

From the foregoing description, it is understood that, according to the present invention, the formation of gaseous ruthenium resulting from the oxidation of ruthenium with a gas produced by decomposition of nitric acid or nitrate contained in a liquid waste during melting of a glass frit cartridge can be effectively suppressed.

Particularily, in the present invention since the effective contact of the reducing agent with the liquid waste is carried out uniformly through the glass fibers in the cartridge, the denitration in the liquid waste is efficiently accomplished by the reducing agent. As a result, it becomes possible to suppress the oxidation of ruthenium with a gas produced by decomposition of nitric acid or nitrate in the liquid waste.

It will be understood that various changes in the details, materials and steps of the processes which are herein described and illustrated in order to explain the nature of the invention may be effected by those skilled in the art without departing from the scope of the present invention.

What is claimed is:

1. A process of vitrifying a radioactive liquid waste by absorbing a radioactive liquid waste into a glass frit cartridge made of molded glass fibers and heat-melting said cartridge to vitrify said liquid waste, characterized in that a radioactive liquid waste containing ruthenium is absorbed together with a reducing agent in liquid form into said glass frit cartridge, thereby suppressing the formation of gaseous ruthenium during the heat melting.

2. The process according to claim 1, wherein a mixture of said liquid waste and said reducing agent in liquid form is absorbed into said glass frit cartridge.

3. The process according to claim 1, wherein said liquid waste is absorbed into said glass frit cartridge and said reducing agent in liquid form is then absorbed into said cartridge.

4. The process according to claim 1, wherein said reducing agent in liquid form is absorbed into said glass frit cartridge and said liquid waste is &hen absorbed into said cartridge.

5. The process according to claim 1, wherein said glass frit cartridge is a cylindrically-shaped glass fiber aggregate prepared by rolling a sheet of glass fibers.

6. The process according to claim 1, wherein said glass frit cartridge is a cylindrically-shaped glass fiber aggregate prepared by sintering glass fibers in a mold.

7. The process according to claim 1, 2, 3, or 4, wherein said reducing agent in liquid form is selected from the group consisting of formic acid, formalin and aqueous solutions of sugar and corn starch.

8. A process of vitrifying a radioactive liquid waste by absorbing a radioactive liquid waste into a glass frit cartridge made of molded glass fibers and heat-melting said cartridge to vitrify said liquid waste, characterized in that a reducing agent in solid form is previously incorporated in said glass frit cartridge made of molded glass fibers, and a radioactive liquid waste containing ruthenium is then absorbed in to said glass frit cartridge containing said reducing agent, thereby suppressing the formation of gaseous ruthenium during the heat-melting.

9. The process according to claim 8, wherein said reducing agent in solid form is selected from the group consisting of sugar and corn starch.

10. The process according to claim 8, wherein said glass frit cartridge is a cylindrically-shaped glass fiber aggregate prepared by rolling a sheet of glass fibers.

11. The process according to claim 8, wherein said glass frit cartridge is a cylindrically-shaped glass fiber aggregate prepared by sintering glass fibers in a mold.

* * * * *